US010065841B2

(12) United States Patent
Downing

(10) Patent No.: US 10,065,841 B2
(45) Date of Patent: Sep. 4, 2018

(54) COMPACT STOWABLE LUFFING JIB FOR A CRANE

(71) Applicant: Altec Industries, Inc., Birmingham, AL (US)

(72) Inventor: James A. Downing, Salem, VA (US)

(73) Assignee: Altec Industries, Inc., Birmingham, AL (US)

( * ) Notice: Subject to any disclaimer, the term of this patent is extended or adjusted under 35 U.S.C. 154(b) by 210 days.

(21) Appl. No.: 15/006,868

(22) Filed: Jan. 26, 2016

(65) Prior Publication Data

US 2017/0210604 A1 Jul. 27, 2017

(51) Int. Cl.

| | |
|---|---|
| ***B66C 23/70*** | (2006.01) |
| ***B66C 23/68*** | (2006.01) |
| *B66C 23/42* | (2006.01) |

(52) U.S. Cl.

CPC ..... *B66C 23/702* (2013.01); *B66C 23/68* (2013.01); *B66C 23/42* (2013.01)

(58) Field of Classification Search

CPC ..... B66C 23/42; B66C 23/68; B66C 23/702; B66C 23/00; B66C 23/18; B66C 23/36; B66C 23/62; B66C 23/64; B66C 23/70; B66C 23/701

See application file for complete search history.

(56) References Cited

U.S. PATENT DOCUMENTS

| | | | | |
|---|---|---|---|---|
| 3,785,505 | A * | 1/1974 | Keller, Jr. | B66C 23/702 212/177 |
| 3,830,376 | A * | 8/1974 | Fritsch | B66C 23/702 212/350 |
| 3,831,771 | A * | 8/1974 | Wiencek | B66C 23/702 212/230 |
| 3,884,359 | A | 5/1975 | Suverkrop | |
| 3,945,333 | A * | 3/1976 | Fritsch | B66C 23/702 212/177 |

(Continued)

OTHER PUBLICATIONS

Terex Cranes, Terex AC 350-6, Patented luffing jib rigging procedure, YouTube Video, published May 15, 2012, https://www.youtube.com/watch?v=iod4i2JKQsU.

(Continued)

*Primary Examiner* — Minh Truong
*Assistant Examiner* — Juan J Campos, Jr.
(74) *Attorney, Agent, or Firm* — Erise IP, P.A.

(57) ABSTRACT

A stowable luffing jib provides easy installation to add luffing capabilities to a crane. The stowable luffing jib comprises a base trunnion, a jib assembly, and a cable strut. The base trunnion is secured to the boom assembly and can be selectively placed into a stowed position and a deployed position. While the base trunnion is in the stowed position, the base trunnion is secured along the boom assembly substantially parallel with and adjacent to the boom assembly. While the base trunnion is in the deployed position, the base trunnion is secured to a distal end of the boom assembly and oriented substantially in line with the boom assembly. The jib assembly is secured to the base trunnion and configured to pivot in a substantially vertical plane. The cable strut receives a luffing guy line so as to set an inclined angle of the cable strut relative to the base trunnion.

18 Claims, 6 Drawing Sheets

(56) References Cited

U.S. PATENT DOCUMENTS

| | | | | | |
|---|---|---|---|---|---|
| 3,968,884 | A | * | 7/1976 | Johnson | B66C 23/702 212/300 |
| 4,318,488 | A | * | 3/1982 | Rathi | B66C 23/702 212/177 |
| 4,383,616 | A | | 5/1983 | Sterner et al. | |
| 4,431,109 | A | * | 2/1984 | Behrendt | B66C 23/702 212/177 |
| 5,842,587 | A | | 12/1998 | Wanek et al. | |
| 2010/0243595 | A1 | | 9/2010 | Walker et al. | |

OTHER PUBLICATIONS

Manitowoc Cranes, Grove GMK6400 Luffing Jib, YouTube Video, published Apr. 12, 2013, https://www.youtube.com/watch?v=BGCg2x0L8xs.

* cited by examiner

COMPACT STOWABLE LUFFING JIB FOR A CRANE

BACKGROUND

1. Field

Embodiments of the invention relate to cranes. More specifically, embodiments of the invention relate to luffing jibs for cranes.

2. Related Art

Cranes, digger derricks, and other heavy equipment utilize a boom assembly, a load line, and a winch to lift heavy loads. The winch is typically disposed on a base, and the load line runs from the winch along the boom assembly to an implement at the distal end of the boom. The implement then routes the load line downward so as to allow a load to be attached thereto. The winch may then be operated to reduce the available length of the load line and therefore lift the load.

Luffing cranes allow the crane to lift the load over a high or large obstacle. The luffing crane enables an operator to move the load laterally along the ground while elevated off the ground. The luffing crane keeps the load at a substantially static height above the ground while moving the load toward or away from the boom. The luffing crane accomplishes this by adjusting an angle of the luffing jib relative to the boom assembly while adjusting the boom angle.

The luffing jib of a luffing crane is typically very large and heavy. As such, it must be transported to a worksite separately from the crane. They also require an additional crane to assist in installation of the luffing jib. Further, luffing jibs also require the operator to run additional hydraulic lines to provide hydraulic power to the luffing jib. This procedure is very time- and labor-intensive. For example, the luffing crane requires three vehicles to be present (i.e., the luffing crane, an assisting crane, and a transportation vehicle). Because of the difficulty and time required to set up, luffing cranes are only used sparingly, such as when a specific need is present at a worksite. What is lacking in the prior art is a luffing crane that is easy and convenient to use.

SUMMARY

Embodiments of the invention solve the above-mentioned problems by providing a compact stowable luffing jib for use on a crane. The stowable luffing jib stows on a boom assembly of the crane when not in use. The stowable luffing jib is therefore always on the boom assembly such that no external transportation is necessary. The stowable luffing jib is configured to connect to a distal end of the boom assembly and swing out from a stowed position to a deployed position. This is accomplished manually by the operator and requires no assisting crane to install the luffing jib. Further, no additional hydraulic lines are needed to perform the luffing functions. The installation and use of the stowable luffing jib is therefore quick and easy to employ. This allows for the luffing capabilities to be used more often and as the need arises (instead of requiring prior planning to utilize the luffing capabilities). The stowable luffing jib may also be added to existing cranes, so as to make this added capability available to crane operators for a relatively low expense. The stowable luffing jib therefore presents a substantial advance in the art by providing luffing capabilities quickly, easily, and inexpensively.

A first embodiment of the invention is directed to a stowable luffing jib that comprises a base trunnion, a jib assembly, and a cable strut. The base trunnion is secured to the boom assembly. The base trunnion can be selectively placed into a stowed position and a deployed position. While the base trunnion is in the stowed position, the base trunnion is secured along the boom assembly substantially parallel with and adjacent to the boom assembly. While the base trunnion is in the deployed position, the base trunnion is secured to a distal end of the boom assembly and oriented substantially in line with the boom assembly. The jib assembly is secured to the base trunnion and configured to pivot in a substantially vertical plane. The cable strut secured to the base trunnion and configured to pivot in a substantially vertical plane to receive a luffing guy line so as to set an inclined angle of the cable strut relative to the base trunnion. The stowable luffing jib may also include a static-length guy line for keeping the cable strut and the jib assembly at a consistent relative angle.

A second embodiment is directed to a crane with an associated stowable luffing jib. The crane comprises a base, a boom assembly, a first winch, a second winch, and a stowable luffing jib. The boom assembly presents a proximal end and a distal end, and the proximal end of the boom assembly is rotatably secured to the base. The first winch selectively releases a load line to support a load. The second winch selectively releases a luffing guy line to set a declined angle. The stowable luffing jib is associated with the boom assembly and configured to be selectively placed into a stowed orientation and a deployed orientation. The stowed orientation is defined by the stowable luffing jib being secured to a transportation bracket on an outer boom section of the boom assembly. The load line lifts the load via the distal end of the boom assembly while the stowable luffing jib is in the stowed orientation. The deployed orientation is defined by the stowable luffing jib being installed on the distal end and set at said declined angle, such that the load line lifts the load via the stowable luffing jib.

A third embodiment is directed to a method of adding luffing capabilities to a boom assembly of a crane, the method comprising the following steps: retracting the boom assembly such that an implement at a distal end of the boom assembly aligns with a stowable luffing jib; securing the stowable luffing jib to the implement; releasing the stowable luffing jib from a transportation bracket; swinging the stowable luffing jib from a stowed position to a deployed position, wherein the deployed orientation is defined by the stowable luffing jib being installed on the distal end such that the load line lifts the load via the stowable luffing jib; running a load line from a first winch through the stowable luffing jib such that it passes over a boom-jib sheave and a jib-load sheave; running a luffing guy line from a second winch through a cable strut of the stowable luffing jib; attaching a static-length guy line between a distal end of the cable strut and a distal end of a jib assembly of the stowable luffing jib; retracting the luffing guy line so as to set an inclined angle of the cable strut; raising the boom assembly to a certain boom angle; allowing the weight of the jib assembly to set a declined angle of the jib assembly relative to the boom angle; and securing a load to the load line.

Additional embodiments of the invention are directed to a method of installing the stowable luffing jib, a method of using the stowable luffing jib, a method of lifting an object supported by the stowable luffing jib, etc.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
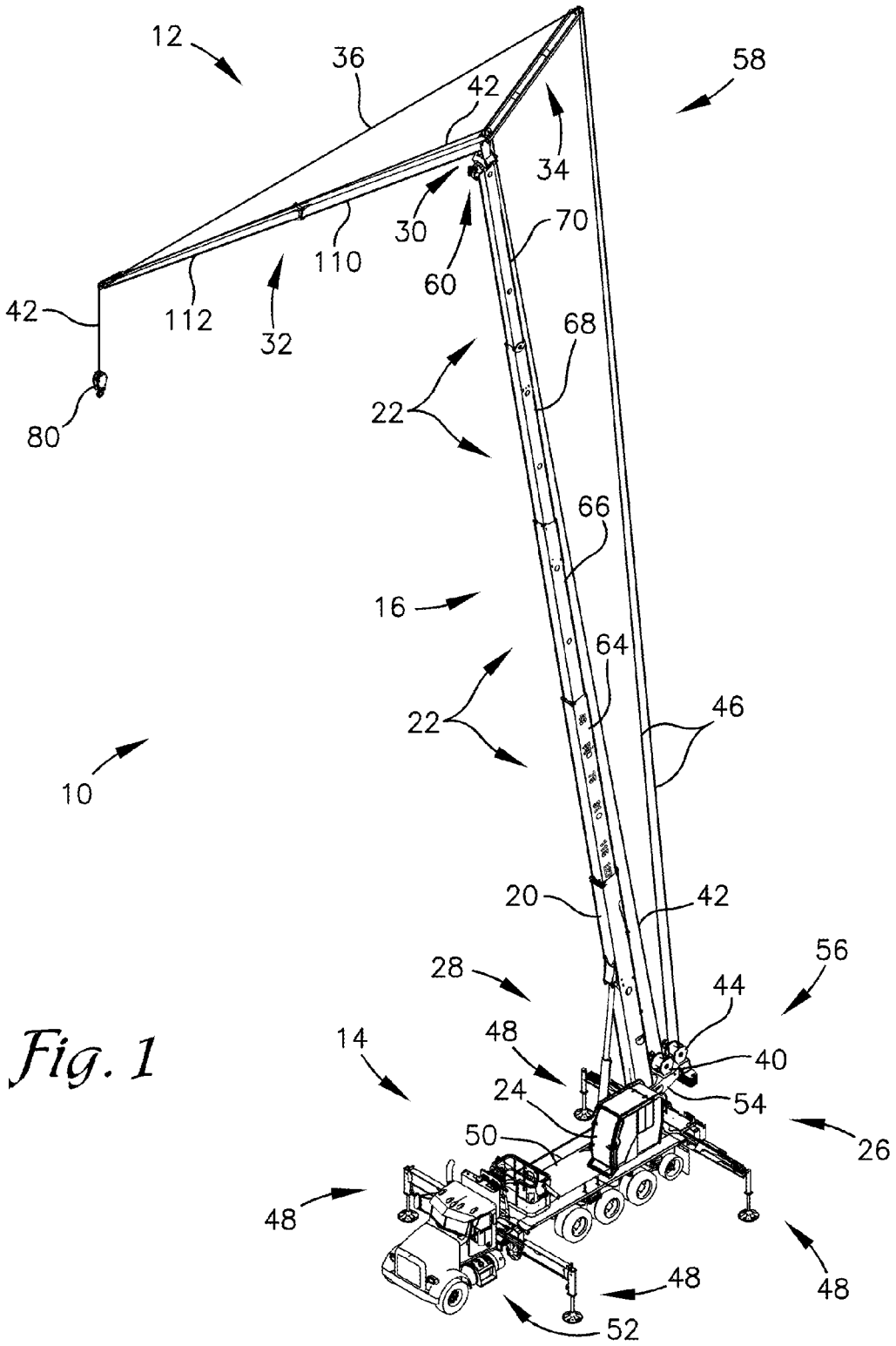
FIG. 1 is a perspective view of a crane with a stowable luffing jib in a deployed position.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 2:
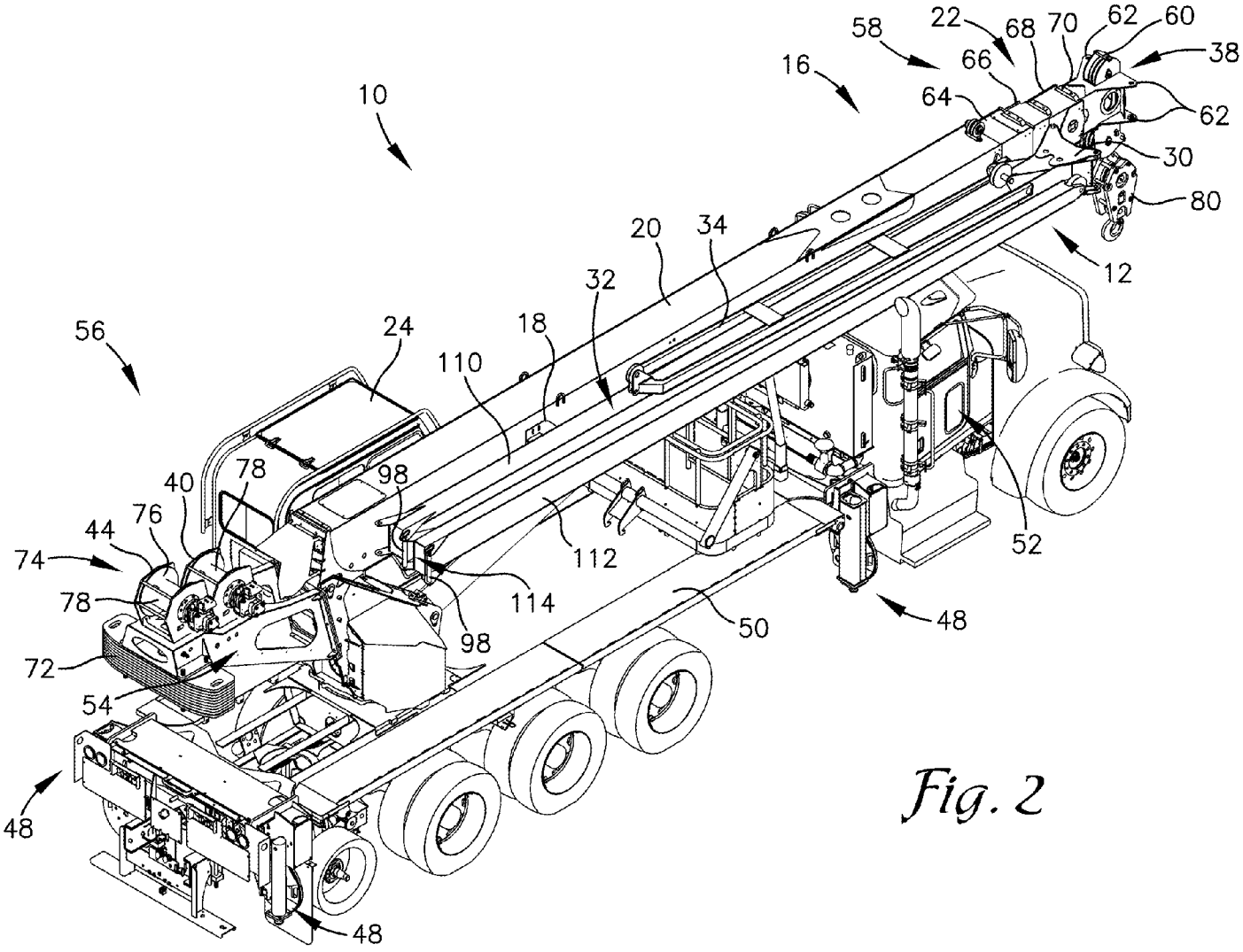
FIG. 2 is a perspective view of the stowable luffing jib of FIG. 1.
Figure 3:
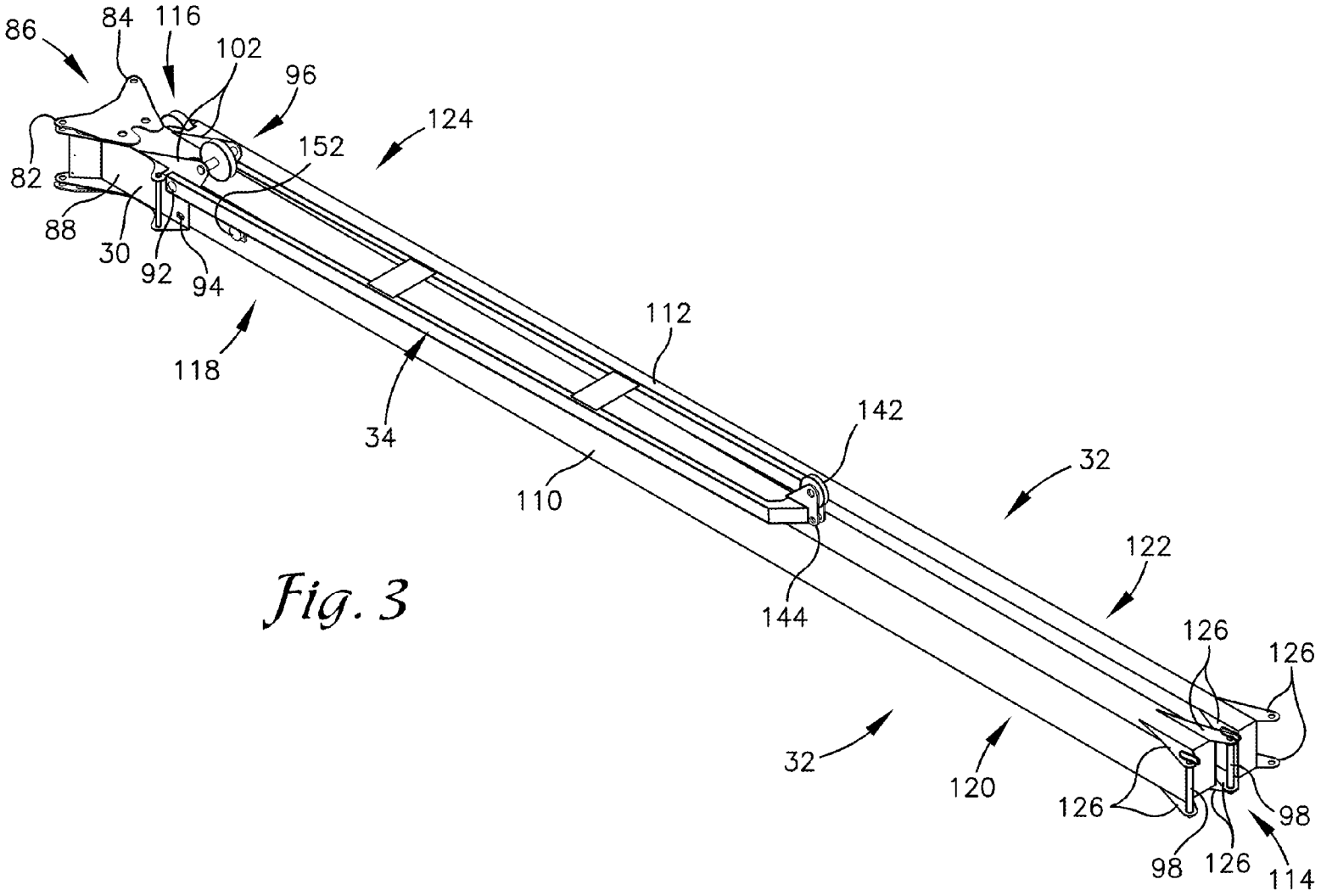
FIG. 3 is a perspective view of a base trunnion and a cable strut of the stowable luffing jib.

A crane 10 utilizing a stowable luffing jib 12, constructed in accordance with various embodiments of the invention, is shown in FIG. 1. The crane 10 generally comprises a base 14 with a boom assembly 16 rotatably mounted thereto. The stowable luffing jib 12 is disposed on the boom assembly 16 such that it can be selectively employed as required for the completion of a task by the operator. The stowable luffing jib 12 is configured to be selectively placed into a stowed position (as illustrated in FIG. 2) and an engaged position (as illustrated in FIG. 1. In the stowed position, as illustrated in FIG. 2, the stowable luffing jib 12 is secured in a transport bracket alongside the boom assembly 16, such that the boom assembly 16 can be used in the standard fashion (for example, directly from the boom assembly 16). The stowed orientation is defined by the stowable luffing jib 12 being substantially parallel and adjacent to an outer boom section 20 of the boom assembly 16, as illustrated in FIGS. 2 and 3. At least one inner boom section 22 of the boom assembly 16 can telescope out of the outer boom section 20. As such the stowable luffing jib 12 remains in the transportation bracket 18 alongside the outer boom section 20 of the boom assembly 16.

In embodiments of the invention, a static-operations cab 24 is disposed on a first side 26 of the boom assembly 16 and the transportation bracket 18 for the stowable luffing jib 12 is disposed on a second side 28 of the boom assembly 16. This prevents the stowable luffing jib 12 from obstructing the operator's view of the boom assembly 16 and the load while the stowable luffing jib 12 is in the stowed position. As can be seen in FIG. 1, in embodiments of the invention, the first side 26 is to the left of the boom assembly 16 (as viewed from the static-operations cab 24) and the second side 28 is to the right of the boom assembly 16. In this way, the stowable luffing jib 12 is kept in a location and orientation such that it is quick and easy to install when needed, but is unobstructive and securely stowed when not needed.

When the luffing capabilities are desired or required, the operator retracts the boom assembly 16. The operator then secures the stowable luffing jib 12 to the distal end of the boom assembly 16 and releases the stowable luffing jib 12 from the transportation bracket 18. The operator then swings the stowable luffing jib 12 from the stowed position to the deployed position. The deployed orientation is defined by the stowable luffing jib 12 being installed on the boom assembly such that the load line 42 lifts the load via the stowable luffing jib 12 (as illustrated in FIG. 1). Once in the deployed position, the operator installs the stowable luffing jib 12 such that the stowable luffing jib 12 may assist in the performance of the task (by acting either as a standard jib or a luffing jib).

It should be appreciated that, unlike in the prior art discussed above, the above steps are performed by the operator manually and/or with the assistance of hydraulic actuators on the crane 10. An extra assisting crane 10 is not required to deploy the stowable luffing jib 12. Further, the stowable luffing jib 12 is secured in the transportation bracket 18 during transportation to and from the worksite. In this way, an external transportation vehicle is not required to move the stowable luffing jib 12 to the worksite.

As discussed in depth below and best illustrated in FIGS. 3 and 4, in embodiments of the invention, the stowable luffing jib 12 comprises a base trunnion 30, a jib assembly 32, a cable strut 34, and a static-length guy line 36 (not illustrated in FIG. 3). When in the deployed position, the base trunnion 30 is disposed on a distal edge 38 of the boom assembly 16 and oriented in line with the boom assembly 16. The jib assembly 32 is oriented downward (i.e., closer to horizontal than the boom angle) at a declined angle and the cable strut 34 is oriented upward (i.e., inclined more than the boom angle) at an inclined angle. The decline angle is labeled as angle $\theta_1$ and the inclined angle is labeled as angle $\theta_2$ in FIG. 4. The jib assembly 32 and the cable strut 34 present a static angle therebetween as set by the length of the static-length guy line 36. The static angle is the summation of angle $\theta_1$ and angle $\theta_2$. If the stowable luffing jib 12 is being utilized as a standard jib, the declined angle is static, which may be accomplished by pinning the jib assembly 32 in a certain orientation. If the stowable luffing jib 12 is being utilized as a luffing jib, the declined angle is varied so as to control the location of the load.

Returning to FIGS. 1 and 2, a first winch 40 selectively releases a load line 42 to support the load. The load line 42 traverses from the first winch 40 up the boom assembly 16, across the stowable luffing jib 12, and down to the load. A second winch 44 selectively releases a luffing guy line 46 that sets the declined angle of the stowable luffing jib 12. The declined angle is the measure of the angle to which the stowable luffing jib 12 is set relative to the boom angle (as illustrated in FIG. 4). As the boom angle is adjusted (such as by tipping the boom assembly 16 upward or downward), the declined angle is adjusted accordingly so as to the keep the load at a substantially level height and move the load away from the crane 10 or toward the crane 10. The operation of the first winch 40 and the second winch 44 are controlled such that the location and orientation of the load are carefully controlled and monitors. This gives enhanced control to the operator to move the load safely over large obstacles and the like. The winches 40, 44 are discussed more below.

In embodiments of the invention, each of the load line 42 and the luffing guy line 46 is a long steel cable, or other long metallic cable. The load line 42 is capable of supporting very large loads without breakage, failure, or substantial deformation. The luffing guy line 46 is capable of keeping the cable strut 34 aligned at a desired inclined angle while the stowable luffing jib 12 is under the weight of the load. An exemplary load line 42 or luffing guy line 46 can weigh approximately one pound per foot of length and be ⅝ inch in diameter. The load line 42 and the luffing guy line 46 are best illustrated in FIGS. 1 and 4.

The base 14 of the crane 10 is a selectively stabilized platform illustrated in FIGS. 1 and 2. In embodiments of the invention, the base 14 is a crane 10 chassis (as illustrated in FIGS. 1 and 2), a utility truck, an aerial device, an oil rig, an earth-working machine, or a fixed structure. The base 14 provides stability and a counterweight 72 to a load being supported by the boom assembly 16 and the stowable luffing jib 12. Larger loads typically require a more stable and a heavier base 14. To achieve this stability, in embodiments of the invention, the base 14 may utilize a set of outriggers 48 or other hydraulic stabilizers. The base 14 may also present a deck 50 upon which the operator can stand to assist the operator in performing the task. Further, the base 14 includes a mobile-operations cab 52, which the operator uses to drive the crane 10 between worksites.

In embodiments of the invention such as illustrated in FIGS. 1 and 2, the boom assembly 16 broadly comprises the static-operations cab 24, a winch support 54, the first winch 40, the second winch 44, the outer boom section 20, and the at least one inner boom section 22. The boom assembly 16 presents a general proximal end 56 and a general distal end 58. The proximal end 56 is rotatably and/or pivotably secured to a portion of the base 14. The static-operations cab 24, the winch support 54, the first winch 40, and the second winch 44 are all disposed toward the proximal end 56 of the boom assembly 16. As such, these components rotate in conjunction with the boom assembly 16. This keeps the static-operations cab 24, the winch support 54, the first winch 40, and the second winch 44 all aligned with the rest of boom assembly 16.

The distal end 58 of the boom assembly 16 comprises an implement 60 for directing the load line 42 downward when the stowable luffing jib 12 is in the stowed position. The implement 60 may also perform other standard crane 10 functions. The stowable luffing jib 12 is selectively and pivotably secured to the implement 60 and/or another component of the distal end 58 of the boom assembly 16. In embodiments of the invention, the stowable luffing jib 12 is selectively secured to a trunnion interface segment 62 on the implement 60. The trunnion interface segment 62 is configured to allow the stowable luffing jib 12 to pivot therearound from the stowed position to the engaged position. While in the stowed position, the stowable luffing jib 12 is pivoted approximately 180 degrees such that the base trunnion 30 of the stowable luffing jib 12 is substantially pointed parallel to but in a reverse direction of the boom assembly 16, as illustrated in FIG. 3.

The at least one inner boom section 22 is at least in part disposed within the outer boom section 20. The at least one inner boom section 22 telescopes to extend or retract into the outer boom section 20. In embodiments of the invention, the boom assembly 16 may comprise additional equipment including any of the following: power lines for the routing of hydraulic, pneumatic, or electrical power; communication wires for user-controls and sensors; and the like (not illustrated). In some embodiments of the invention, the boom assembly 16 comprises a first boom section that rotatably secured to the base 14 and a second boom section rotatably secured to a distal end of the first boom section (not illustrated). In still other boom assemblies, a combination of the telescoping and pivoting boom sections is utilized (not illustrated).

The at least one inner boom section 22 may telescope into a plurality of positions with respect to the outer boom section 20, including a fully retracted position, in which the length of the at least one inner boom section 22 is substantially inserted within the outer boom section 20 (as illustrated in FIG. 2), and a fully extended position, in which only a relatively small portion of the length of the at least one inner boom section 22 is inserted within the outer boom section 20 (as illustrated in FIG. 1).

In embodiments of the invention, such as illustrated in FIGS. 1 and 2, the boom assembly 16 comprises the outer boom section 20, a first inner boom section 64, a second inner boom section 66, a third inner boom section 68, and a fourth inner boom section 70. The first inner boom section 64 is disposed at least partially within the outer boom section 20. The second inner boom section 66 is disposed at least partially within the first inner boom section 64. The third inner boom section 68 is disposed at least partially within the second inner boom section 66. The fourth inner boom section 70 is disposed at least partially within the third inner boom section 68. The implement 60 is disposed on the fourth inner boom section 70. In embodiments of the invention, the various inner boom sections 22 all telescope in concert, such that each is disposed within its respective boom section an approximately equal amount. In other embodiments, each inner boom section 22 telescopes independently.

The boom assembly 16 of the crane 10 typically includes the first winch 40 and the second winch 44. The first winch 40 is typically disposed on or near the boom assembly 16 for selectively releasing the load line 42. The load line 42 supports the load from either the boom assembly 16 or the stowable luffing jib 12 (dependent upon which configuration is currently being utilized). The second winch 44 is typically disposed further from the boom assembly 16 than the first winch 40 is located for selectively releasing the luffing guy line 46. This is because the luffing guy line 46 is used to set the inclined angle of the cable strut 34, as discussed below. In some embodiments of the invention, the winch support 54 further comprises a counterweight 72 still further from the boom assembly 16. The counterweight 72 prevents damage to the crane 10 by leveling the load somewhat from before and behind the rotation point of the boom assembly 16.

In embodiments of the invention, the first winch 40 is substantially similar to the second winch 44. Each of the first winch 40 and the second winch 44 is disposed at the proximal end 56 of the boom assembly 16 so as to keep the first winch 40 and the second winch 44 aligned with the boom assembly 16 while the boom assembly 16 rotates about the base 14. Each winch 40, 44 includes a spool 74 and an associated hydraulic motor (not illustrated). The spool 74 includes two end caps 76 and a central section 78. The spool 74 rotates about a horizontal, lateral axis in response to actuation by the hydraulic motor.

The load line 42 is wrapped around the central section 78 of the first winch 40 and prevented from falling therefrom by the two end caps 76 of the first winch 40. Similarly, the luffing guy line 46 is wrapped around the central section 78 of the second winch 44 and prevented from falling therefrom by the two end caps 76 of the second winch 44. The hydraulic motor or other actuator spins each spool 74 independently so as to let out (i.e., elongate) or take in (i.e., shorten) the load line 42 and the luffing guy line 46, respectively.

The load line 42 includes a heavy terminal hook 80 disposed beyond the implement 60 and/or the jib assembly 32. The terminal hook 80 therefore pulls the load line 42 to elongate upon the hydraulic motor spinning the spool 74 in an elongating direction. The hydraulic motor takes in the load line 42 by spinning the spool 74 in a shortening direction. The hydraulic motor is therefore strong enough to lift the load by shortening the load line 42 while the load is attached to the load line 42 through either the implement 60 or the stowable luffing jib 12.

The components of the stowable luffing jib 12 will now be discussed in greater detail. As discussed above and best illustrated in FIGS. 3 and 4, in embodiments of the invention, the stowable luffing jib 12 comprises the base trunnion 30, the jib assembly 32, the cable strut 34, and the static-length guy line 36. The base trunnion 30 is configured to align with and be secured to the implement 60 of the boom assembly 16. The base trunnion 30 thereafter provides support for the jib assembly 32 and the cable strut 34 to be pivotably secured thereto. The jib assembly 32 is secured to the cable strut 34 via the static-length guy line 36.

Figure 5:
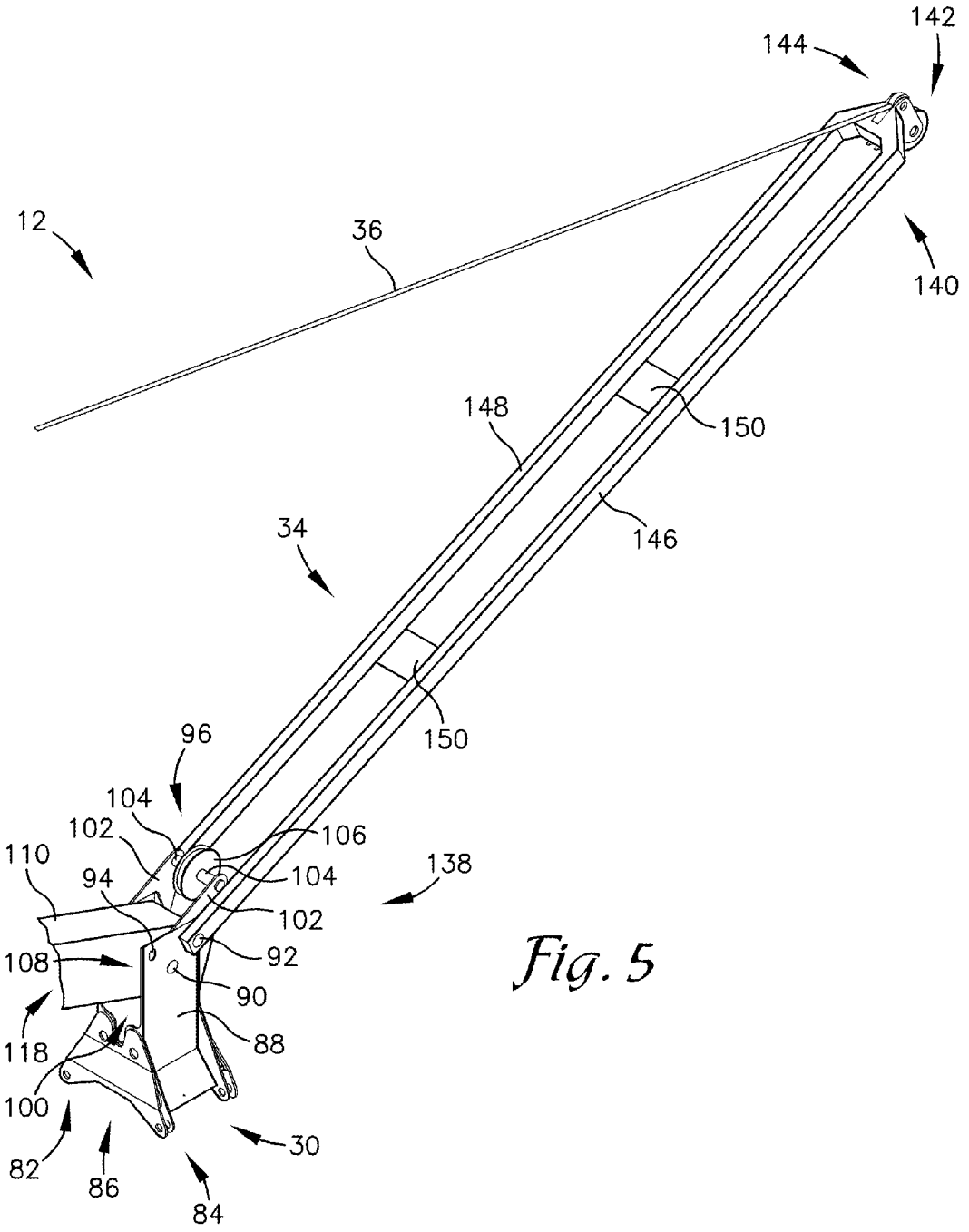
FIG. 5 is a perspective view of a distal end of the jib assembly of the stowable luffing jib.

The base trunnion 30 is configured to be secured to the implement 60 at the distal end 58 of the boom assembly 16. As best illustrated in FIG. 5, in embodiments of the invention the base trunnion 30 comprises a hinge segment 82, a lock segment 84, a flared implement interface 86, a body 88, a jib pivot 90, a strut pivot 92, a jib angle lock 94, and a boom-jib sheave 96. The base trunnion 30 selectively interfaces with the implement 60 (or other component of the boom assembly 16) to provide a stable base for the stowable luffing jib 12. The base trunnion 30 allows the other components of the stowable luffing jib 12 (such as the jib assembly 32 and the cable strut 34) to pivot therefrom.

The hinge segment 82 overlaps the trunnion interface segment 62 of the implement 60. As such, when the boom assembly 16 is fully retracted (e.g., slightly further than illustrated in FIG. 2), the hinge segment 82 aligns with the trunnion interface segment 62. The operator may then place a fastener, place a pivot bolt 98, or otherwise secure the hinge segment 82 with the trunnion interface segment 62. Pivotably securing the hinge segment 82 to the trunnion interface segment 62 allows the operator to then pivot the stowable luffing jib 12 about the hinge segment 82 from the stowed position to the deployed position (following a release of the transportation bracket 18).

As the base trunnion 30 is moved from the stowed position to the deployed position, the lock segment 84 of the base trunnion 30 comes into contact with the trunnion interface segment 62 on the implement 60. The operator may then lock the base trunnion 30 to the implement 60. The locking of the base trunnion 30 may be done in the same manner in which the hinge segment 82 was secured, such as by placing a fastener, pivot bolt 98 or the like through the lock segment 84.

It should be appreciated that in embodiments of the invention, such as illustrated in FIG. 5, the hinge segment 82 and the lock segment 84 of the base trunnion 30 may each be substantially identical and symmetrical. This can be advantageous in that, as discussed above, the stowable luffing jib 12 is stored on the side of the boom assembly 16 opposite the static-operations cab 24. A symmetrical base trunnion 30 therefore allows either side to hinge and either side to lock. This allows the stowable luffing jib 12 to be retroactively added to cranes 10 in which the static-operations cab 24 is on either side. This makes the stowable luffing jib 12 more versatile to be added to an existing fleet of cranes 10. It should also be appreciated that in some embodiments of the invention, the implement 60 of the existing cranes 10 is changed, replaced, or modified so as to present the trunnion interface segment 62.

While the base trunnion 30 is in the deployed position, the body 88 of the base trunnion 30 is elongated and oriented substantially in line with the boom assembly 16. The body 88 presents a channel 100 into which the jib assembly 32 is pivotably secured via the jib pivot 90. It should also be noted that in embodiments of the invention, the jib pivot 90 and the strut pivot 92 are a common pivot. The elongation of the body 88 allows the jib assembly 32 to pivot away from the implement 60, such that the jib assembly 32 can pivot downward relative to the boom (i.e., at the declined angle, labeled angle $\theta_1$ in FIG. 4) without striking the implement 60. In embodiments of the invention, such as illustrated in FIG. 5, the jib assembly 32 is secured within the channel 100 of the body 88 of the base trunnion 30 and the cable strut 34 is secured externally to the body 88 of the base trunnion 30. In this way, the cable strut 34 and the jib assembly 32 can both pivot without striking the other. Typically, the cable strut 34 and the jib assembly 32 move in concert via the static-length guy line 36.

The jib angle lock 94 secures the jib assembly 32 in a certain orientation relative to the base trunnion 30, and therefore relative to the boom assembly 16. The jib angle lock 94 allows the jib assembly 32 to function to as a standard static-angle jib. The jib angle lock 94 aligns four openings (two in the body 88 of the base trunnion 30 and two in the jib assembly 32). The operator then places a bolt 98 or other fastener through the aligned openings. The bolt 98 prevents the declined angle (i.e. the angle between the boom direction and the jib direction, how far declined the jib assembly 32 is from the original boom direction) from being adjusted thereafter without removing the bolt 98. In these instances the cable strut 34 is not utilized because the luffing capabilities will not be used. The cable strut 34 may be secured in an upward position, or allowed to rest along the jib assembly 32.

Figure 4:
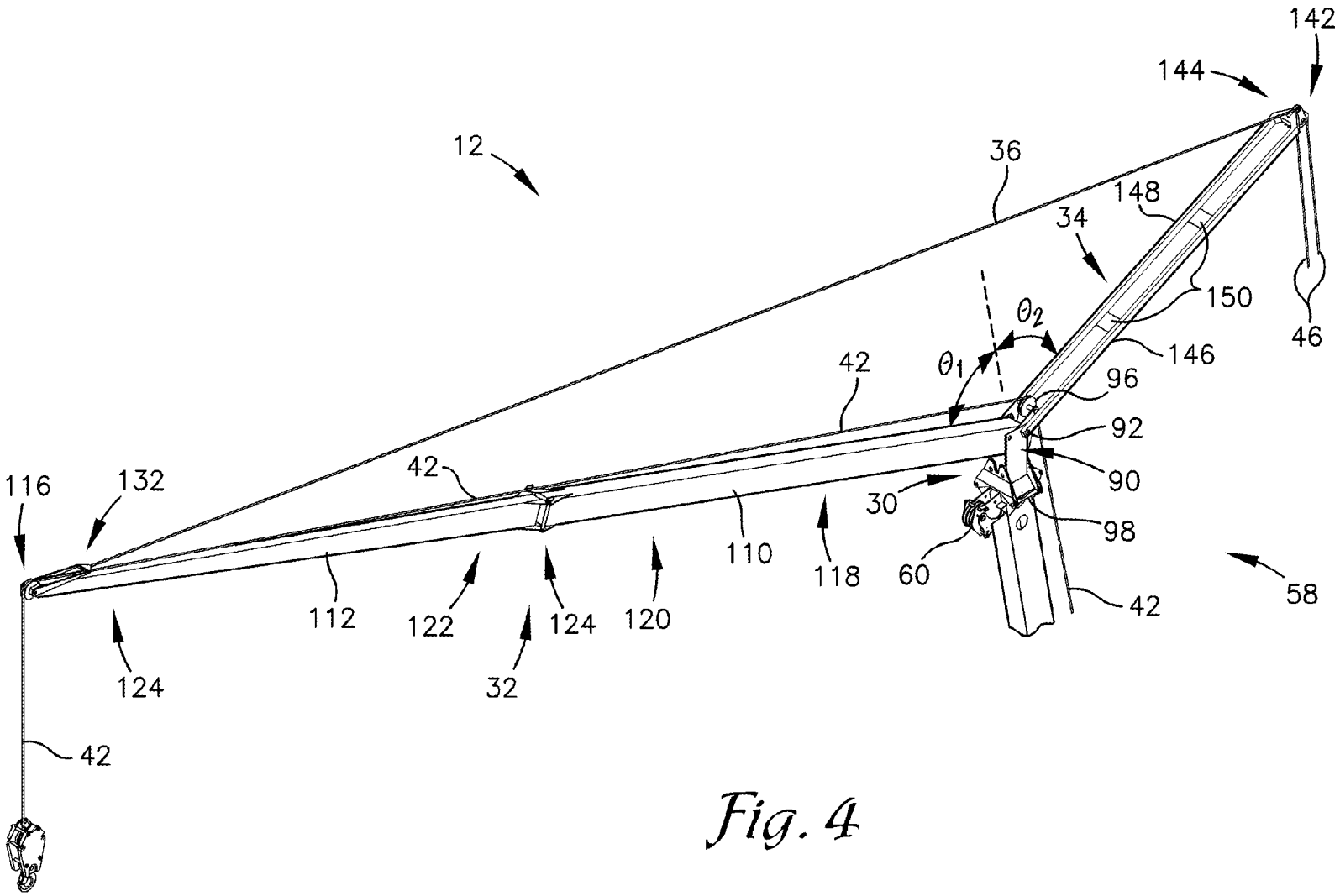
FIG. 4 is a perspective view of an intersection between a first jib section and a second jib section of a jib assembly of the stowable luffing jib.

The boom-jib sheave 96 is configured to allow the load line 42 to pass thereover, as illustrated in FIG. 4. The boom-jib sheave 96 supports and redirects the load line 42 so as to keep the load line 42 proximate the boom assembly 16 and the jib assembly 32 through the declined angle.

During installation, the operator directs the load line 42 from the implement 60 to instead travel over the boom-jib sheave 96 and directs it toward a jib-load sheave 116 of the jib assembly 32 (which will in turn direct the load line 42 from the jib assembly 32 down to the load). The boom-jib sheave 96 is typically free spinning (i.e., not directly powered).

The boom-jib sheave 96 includes a pair of protrusions 102, an axle 104 rotatably disposed between the protrusions 102, and a wheel 106 disposed on the axle 104 (as illustrated in FIG. 5). The pair of protrusions 102 is secured to the base trunnion 30. The pair of protrusions 102 extends forward and upward (as viewed from the boom assembly 16). This allows the boom-jib sheave 96 to direct the load line 42 near, but not in contact with, the base trunnion 30. The pair of protrusions 102 also allows the cable strut 34 to pass over and around the pair of protrusions 102 without contact. The axle 104 and the wheel 106 freely spin within the pair of protrusions 102, such that friction from the load line 42 traveling toward or away from the winch rotates the boom-jib sheave 96. In other embodiments of the invention, the boom-jib sheave 96 is disposed on the cable strut 34.

In embodiments of the invention best illustrated in FIGS. 3 and 4, the jib assembly 32 comprises a trunnion interface 108, a first jib section 110, a second jib section 112, a section interface 114, and a jib-load sheave 116. The jib assembly 32 is pivotably secured to the base trunnion 30, such that the jib assembly 32 can pivot in a substantially vertical plane relative to the base trunnion 30. The jib assembly 32 is configured to be disposed at the declined angle from the base trunnion 30. As discussed above, the declined angle is closer to horizontal than the boom angle in which the boom is disposed relative to horizontal. The jib assembly 32 is elongated such that it can move the load line 42 laterally further away from the implement 60 (and therefore further from the base 14 of the crane 10). This can be advantageous in several situations such as lifting the load over or on top of a high or large obstacle, moving the load across a large expanse, or the like.

In embodiments of the invention, the first jib section 110 of the jib assembly 32 is elongated so as to present a proximal end 118 and a distal end 120. The proximal end 118 of the first jib section 110 is pivotably secured to the base trunnion 30 at the trunnion interface 108. The trunnion interface 108 of the first jib section 110 is disposed within the channel 100 of the base trunnion 30. The trunnion interface 108 presents an opening through which the pivot bolt 98 (or other fastener is disposed). The pivot bolt 98 allows the first jib section 110 (and by extension, the entire jib assembly 32) to pivot downward from aligned with the boom assembly 16 to the angle $\theta_1$ of FIG. 4. The proximal end 118 of the first jib section 110 may also comprise an arcuate or beveled top corner to allow for the pivoting within the base trunnion 30. The base trunnion 30 may also prevent the jib assembly 32 from being disposed at an inclined angle (i.e., higher than the boom assembly 16).

In embodiments of the invention, the second jib section 112 is also elongated so as to present a proximal end 122 and a distal end 124. The proximal end 122 of the second jib section 112 is secured to the distal end 120 of the first jib section 110, as discussed below. The jib-load sheave 116 is disposed at the distal end 124 of the second jib section 112 to redirect the load line 42 downward toward the load. The second jib section 112 therefore furthers the reach of the jib assembly 32. The first jib section 110 is pivotably secured to the second jib section 112 at the section interface 114.

Figure 6:
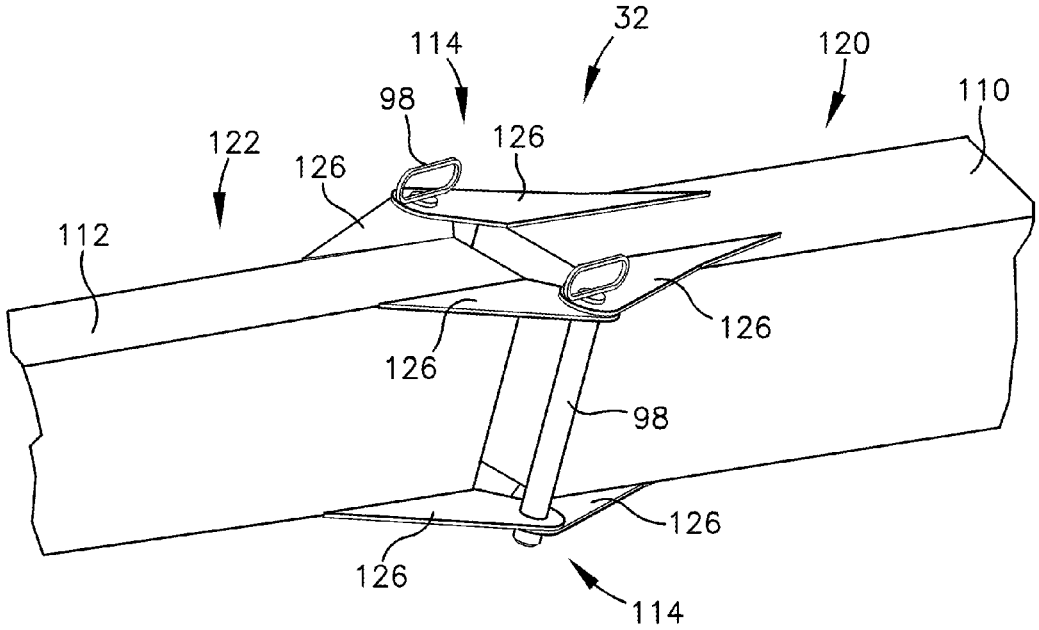
FIG. 6 is a perspective view of the crane with the stowable luffing jib in a stowed position.

As best illustrated in FIG. 6, the section interface 114 allows the second jib section 112 to hinge around and be disposed next to the first jib section 110 during stowage. The section interface 114 is similar to the lock segment 84 and the hinge segment 82. The section interface 114 comprises four protrusions 126 on each of the first jib section 110 and the second jib section 112 (only three of which are visible in FIG. 6 and all four are visible in FIG. 3). Each of the protrusions 126 extends such that they overlap with a corresponding protrusion 126 on the other jib section 110, 112.

When in the stowed position as illustrated in FIG. 3, the second jib section 112 is configured to pivot about a horizontal plane such that the second jib section 112 is adjacent and parallel to the first jib section 110 while the base trunnion 30 is in the stowed position. In the stowed position, the first jib section 110 is aligned with the base trunnion 30 via the jib angle lock 94. It should be appreciated that each of the base trunnion 30 and the second jib section 112 folds horizontally. This allows the operator to fold and unfold the stowable luffing jib 12 from the stowed position to the deployed position under his or her own manual power. This prevents the necessity of an assisting crane 10 for installation (as in the prior art, discussed above). The jib assembly 32 declines under its own weight and the cable strut 34 inclines via the second winch 44 retracting the luffing guy line 46. Therefore, the full installation process can take place simply and easily.

In embodiments of the invention, both the first jib section 110 and the second jib section 112 are tapered such that the respective distal ends 120, 124 present a smaller cross-sectional area (about a vertical cross-section) than their respective proximal ends 118, 122 (as best illustrated in FIG. 4). Further, the proximal end 122 of the second jib section 112 presents a cross-sectional area that is the same as or similar to the cross-sectional area presented by the distal end 120 of the first jib section 110. As such, the jib assembly 32 presents an overall tapered shape along the length of the jib assembly 32. In other embodiments of the invention.

In other embodiments, not illustrated, the second jib section 112 telescopes within the first jib section 110. In still other embodiments, the jib assembly 32 comprises a single jib section. In yet further embodiments, the first jib section 110 includes an alternate jib-load sheave 116 (not illustrated) at the distal end 120 of the first jib section 110, such that the first jib section 110 can be utilized without the second jib section 112 if a shorter jib is desired by the operator.

In still other embodiments, not illustrated the jib assembly 32 further comprises a third jib section, a fourth jib section, etc. The third jib section and/or the fourth jib section allows the operator even greater customization in selecting the length of the jib assembly 32 that is most appropriate for the given task. The second jib section 112 may be secured to the third jib section via a section interface 114 that is similar to the section interface 114 securing the second jib section 112 to the first jib section 110.

Figure 7:
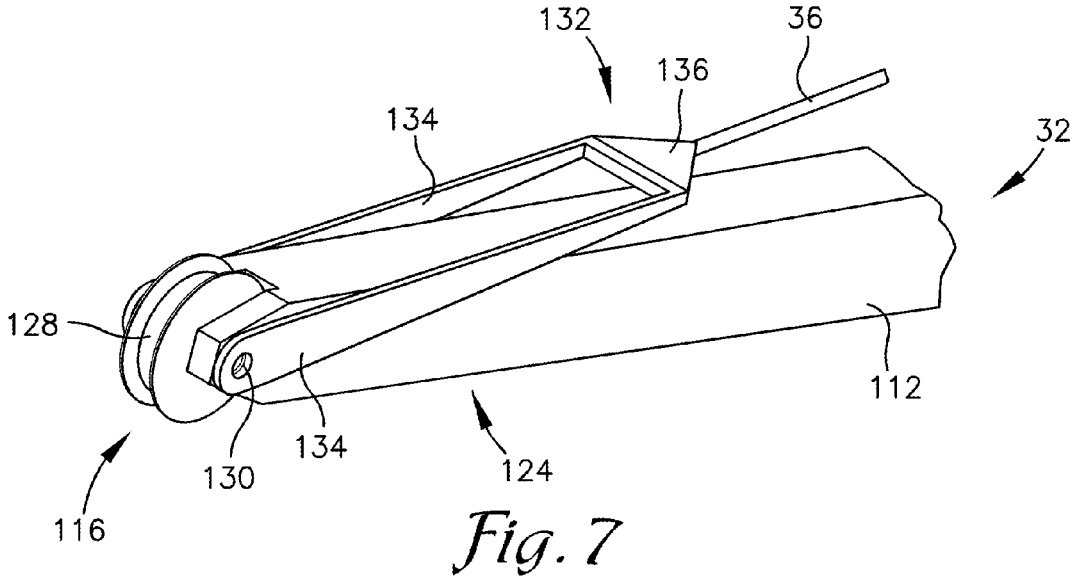
FIG. 7 is a perspective view of the stowable luffing jib in the stowed position.

As best illustrated in FIG. 7, the jib-load sheave 116 is disposed at the distal end 124 of the second jib section 112. The jib-load sheave 116 is configured to allow the load line 42 to pass over the distal end 124 of the second jib section 112 so as to support a load therefrom. The jib-load sheave 116 includes a wheel and an axle 130 that rotate within the distal end 124 of the second jib section 112. The jib-load sheave 116 is typically free spinning such that the friction of the load line 42 travelling thereover rotates the jib-load sheave 116.

The jib-load sheave 116 may also include a distal static-line anchor 132 disposed at the distal end 124 of the second jib section 112 (as illustrated in FIG. 7). In embodiments of the invention, the distal static-line anchor 132 is bifurcated so as to comprise a set of anchor protrusions 134 and a cable interface 136 therebetween. The distal static-line anchor 132 allows the load line 42 can pass under the cable interface 136 and between the anchor protrusions 134 of the distal static-line anchor 132. This allows the load line 42 can traverse from the boom-jib sheave 96 to the jib-load sheave 116 unobstructed. This configuration also keeps the load line 42 and the static-length guy line 36 vertically aligned such that neither imparts a torque on the jib assembly 32. Due to the heavy loads, unaligned components could impart a large torque on the stowable luffing jib 12 that could cause a structural failure.

Returning to FIG. 5, in embodiments of the invention, the cable strut 34 is pivotably secured to the base trunnion 30 at the strut pivot 92. The cable strut 34 is configured rise relative to the boom assembly 16 at the inclined angle so as to support the luffing guy line 46 from the second winch 44. The cable strut 34 is elongated so as to present a proximal end 138 and a distal end 140. The proximal end 138 of the cable strut 34 is pivotably secured to the base trunnion 30. The distal end 140 of the cable strut 34 comprises a luffing sheave 142 and a proximal static-line anchor 144. The luffing sheave 142 receives the luffing guy line 46 from the second winch 44 and redirects the luffing guy line 46 back down to anchor at or near the winch support 54 or other portion of the boom assembly 16. The luffing sheave 142 allows the luffing guy line 46 to freely return down to the proximal end 56 of the boom assembly 16. The proximal static-line anchor 144 is proximate to and aligned with the luffing sheave 142 so as to keep the static-length guy line 36 aligned with the other components of the stowable luffing jib 12.

In embodiments of the invention, the cable strut 34 comprises a first-side segment 146, a second-side segment 148, and at least one traversing support 150. The first-side segment 146 and the second-side segment 148 are elongated so as to span from the proximal end 138 to the distal end 140. The traversing supports 150 are disposed between the first-side segment 146 and the second-side segment 148 so as to provide lateral support. The load line 42 therefore passes between the first-side segment 146 and the second-side segment 148 and below the traversing support 150. In other embodiments of the invention, the load line 42 may pass through an opening in the cable strut 34 (not illustrated).

The luffing guy line 46 is configured to set the inclined angle of the cable strut 34 relative to the boom assembly 16. By shortening the luffing guy line 46, the luffing sheave 142 is pulled downward (i.e., toward the second winch 44). This increases the inclined angle by pivoting the distal end 140 of the cable strut 34 away from being aligned with the boom assembly 16. The second winch 44 therefore elongates and shortens the luffing guy line 46 so as to set the inclined angle.

The static-length guy line 36 is configured to run from the distal end 140 of the cable strut 34 to the distal end 124 of the second jib section 112 (or of the jib assembly 32 generally), as illustrated in FIG. 4. The static-length guy line 36 is secured to the distal end 140 of the cable strut 34 via the proximal static-line anchor 144. The static-length guy line 36 is also secured to the distal end 124 of the second jib section 112 via the distal static-line anchor 132. The static-length guy line 36 presents a fixed length. As such, the static-length guy line 36 keeps the static angle (i.e., the summation of angle $\theta_1$ and angle $\theta_2$ as illustrated in FIG. 4) fixed between the jib assembly 32 and the cable strut 34. The summation of angle $\theta_1$ and angle $\theta_2$ is fixed because the static-length guy line 36 transfers an increase in one angle with a corresponding decrease in the other angle (or vice versa). The static-length guy line 36 therefore translates the change in the inclined angle of the cable strut 34 set by the second winch 44 into a corresponding change in the declined angle of the jib assembly 32. This allows the second winch 44 to therefore set the declined angle of the jib assembly 32, which is desired so as to give the stowable luffing jib 12 the luffing capabilities to lift the load over high and distant obstacles.

The stowable luffing jib 12 is returned from the deployed position to the stowed position by reversing the deployment steps. However, lowering the cable strut 34 back down level with the first jib section 110 requires additional assistance beyond the operator's manual manipulations. While the cable strut 34 was pulled to vertical via the second winch 44 shortening the luffing guy line 46, reversing this process will not drop the cable strut 34 back down flat (and even if it could, it would crash down violently). In embodiments of the invention, the stowable luffing jib 12 may include a hydraulic actuator to gently lower the cable strut 34 back down to horizontal (not illustrated). In other embodiments, the operator may reroute the load line 42 about the jib-load sheave 116 so as to secure to the distal end 140 of the cable strut 34. In this way, the operator can manipulate the first winch 40 and the second winch 44 in concert so as to lower the cable strut 34 back down. In still other embodiments, an assisting crane 10 may lower the cable strut 34.

As discussed above, the stowable luffing jib 12 is configured to be utilized in a luffing orientation and a standard orientation. The luffing orientation has been discussed above, such that second winch 44 can set by the second winch 44 adjusting the length of luffing guy line 46 to the cable strut 34. Thus, the declined angle is variable and varied as desired to control the load. This allows the crane 10 to lift the load in a luffing configuration such that the crane 10 can push the load farther (or pull the load closer) to the crane 10 while keeping the load substantially level with the ground.

In the standard orientation the jib is kept at a constant angle relative to the boom assembly 16. This may be accomplished by placing a pivot bolt 98 through the jib angle lock 94. This keeps the declined angle static, such that it can only be changed by removing the pivot bolt 98. In embodiments of the invention, there may be multiple jib angle locks 94 such that the operator can select any of several static declined angles. It should also be appreciated that the operator may be required to ascend a ladder or aerial device to reach the distal end 58 of the boom assembly 16 so as to set this declined angle.

In embodiments of the invention, the stowable luffing jib 12 further comprises an angle sensor 152, as illustrated in FIG. 3. The angle sensor 152 detects the inclined angle of the cable strut 34, the declined angle of the jib assembly 32, or both. The angle sensor 152 provides information indicative of this angle or angles to a computer control system of the crane 10. The computer control system of the crane 10 controls and monitors crane 10 operations to ensure that the crane 10 is operated safely. The computer control system may be located in the static-operations cab 24, the mobile-operations cab 52, etc. The computer control system displays current information about the load, the orientations of the various boom components, any limitations or safety considerations, etc. The computer control system calculates moments, torques, and other stresses on the crane 10 and ensures that the operation does not exceed safety guidelines. If the operator approaches an overload or other failure, the computer control system may provide warnings, prevent certain actions, and even take preventative actions to prevent damage and failure.

The computer control system instructs the first winch 40, the second winch 44, and the boom assembly 16 to perform various operations. As such, the computer control system can manipulate the stowable luffing jib 12 despite having no direct control over the stowable luffing jib 12. In embodiments of the invention in which the stowable luffing jib 12 is added to an existing crane 10, the computer control system may be updated or edited so as to allow the computer control system to successfully control the stowable luffing jib 12 via the various components.

A method of installing the stowable luffing jib 12 onto the crane 10 will now be discussed. The method comprises the following steps: installing the transportation bracket 18 onto the second side 28 of the boom assembly 16 (i.e., opposite the static-operations cab 24); installing the stowable luffing jib 12 into the transportation bracket 18; and ensuring that the hinge segment 82 will align with the implement 60 of the boom assembly 16 while the boom assembly 16 is in a fully retracted (or substantially fully retracted) position. The method may further comprise the steps of installing a second winch 44 onto the winch support 54; wrapping the luffing guy line 46 around the second winch 44; and providing for control of the second winch 44 from the computer control system.

A method of using the method of adding luffing capabilities to at the boom assembly 16 of the crane 10 will now be discussed. The method comprises the following steps: retracting the boom assembly 16 such that the implement 60 at the distal end 58 of the boom assembly 16 aligns with the stowable luffing jib 12; securing the stowable luffing jib 12 to the implement 60; releasing the stowable luffing jib 12 from a transportation bracket 18; swinging the stowable luffing jib 12 from a stowed position to a deployed position, wherein the deployed orientation is defined by the stowable luffing jib 12 being installed on the distal end 58 such that the load line 42 lifts the load via the stowable luffing jib 12; running a load line 42 from the first winch 40 through the stowable luffing jib 12 such that it passes over the boom-jib sheave 96 and a jib-load sheave 116; running the luffing guy line 46 from the second winch 44 through the cable strut 34 of the stowable luffing jib 12; attaching the static-length guy line 36 between the distal end 140 of the cable strut 34 and the distal end 124 of the second jib section 112 of the stowable luffing jib 12; retracting the luffing guy line 46 so as to set an inclined angle of the cable strut 34; removing the jib angle lock 94; raising the boom assembly 16 to a certain boom angle; allowing the weight of the jib assembly 32 to set a declined angle of the jib assembly 32 relative to the boom angle; and securing a load to the load line 42.

A method of lighting a load using the crane 10 with the stowable luffing jib 12 installed thereon will be briefly discussed. The method comprises the following steps: securing the load to the load line 42; operating the first winch 40 to manipulate the length of the load line 42; operating the boom assembly 16 to manipulate the orientation of the boom assembly 16 relative to the ground; operating the second winch 44 to manipulate the inclined angle of the cable strut 34; and allowing the static cable 36 to therefore adjust the declined angle of the jib assembly 32. The method may include operating the first winch 40, the boom assembly 16, and the second winch 44 in concert such that the load remains substantially level with the ground and travels toward or away from the base 14 of the crane 10. The method may also include operating the second winch 44 so as to keep the inclined angle constant while the boom assembly 16 is being pivoted upward or downward.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A stowable luffing jib configured to be secured to a boom assembly of a crane, said stowable luffing jib comprising:

a base trunnion configured to be secured to the boom assembly, said base trunnion configured to be selectively placed into a stowed position and a deployed position, wherein while the base trunnion is in the stowed position, the base trunnion is secured along the boom assembly substantially parallel with and adjacent to the boom assembly, wherein while the base trunnion is in the deployed position, the base trunnion is secured to a distal end of the boom assembly and oriented substantially in line with the boom assembly;

a jib assembly secured to the base trunnion and configured to pivot in a substantially vertical plane; and a cable strut secured to the base trunnion and configured to pivot in a substantially vertical plane, wherein the cable strut is configured to receive a luffing guy line so as to set an inclined angle of the cable strut relative to the base trunnion.

2. The stowable luffing jib of claim 1, wherein the stowable luffing jib is substantially symmetrical, such that it is configured to be installed onto either a left side of the boom assembly or a right side of the boom assembly.

3. The stowable luffing jib of claim 1, wherein the base trunnion further comprises:

a boom-jib sheave disposed at a distal end of the base trunnion, wherein the boom-jib sheave is configured to redirect a load line so as to stay substantially parallel with the boom assembly, wherein the load line is received from a first winch associated with the crane, wherein the first winch elongates and shortens the load line so as to raise and lower the load.

4. The stowable luffing jib of claim 1, wherein the base trunnion further comprises:

a flared implement interface for securing the base trunnion to an implement of the boom assembly; and a jib angle lock for locking the jib assembly into a certain orientation relative to the base trunnion.

5. The stowable luffing jib of claim 1, wherein the jib assembly is configured to be disposed at a declined angle from the base trunnion while the base trunnion is in the deployed position, wherein the declined angle is closer to horizontal than an a boom angle in which the boom is disposed relative to horizontal.

6. The stowable luffing jib of claim 1, wherein said jib assembly comprises:

a first jib section pivotably secured at a proximal end to the base trunnion; and a second jib section secured to a distal end of the first jib section.

7. The stowable luffing jib of claim 6, wherein the first jib section is configured to pivot about a substantially vertical plane, wherein the second jib section is configured to selectively pivot about a horizontal plane such that the second jib section is adjacent and parallel to the first jib section while the base trunnion is in the stowed position, wherein the second jib section is configured to lock into alignment with the first jib section while the base trunnion is in the deployed position.

8. The stowable luffing jib of claim 6, wherein the second jib section comprises:

a jib-load sheave disposed at a distal end of the second jib section, wherein the jib-load sheave is configured to allow a load line to pass over the distal end of the second jib section so as to support a load therefrom; and a distal static-line anchor disposed at the distal end of the second jib section.

9. The stowable luffing jib of claim 1, wherein the cable strut is configured to receive a luffing guy line at a distal end from a second winch, wherein the luffing guy line is configured to set a inclined angle of the cable strut relative to the boom assembly, wherein the second winch elongates and shortens the luffing guy line so as to set the inclined angle.

10. The stowable luffing jib of claim 9, further comprising:

a luffing sheave configured to receive the luffing guy line from the second winch and redirect the luffing guy line back down to the proximal end of the boom assembly, wherein the luffing guy line is configured to secure to a luffing anchor on near the second winch.

11. The stowable luffing jib of claim 9, further comprising:

a static-length guy line configured to run from the distal end of the cable strut to a distal end of the jib assembly, wherein the static-length guy line presents a fixed length, wherein the static-length guy line keeps a fixed angle between the jib assembly and the cable strut, wherein a declined angle of the jib assembly relative to the boom assembly is set by adjusting a length of the luffing guy line via the second winch.

12. The stowable luffing jib of claim 1, wherein the stowable luffing jib is configured to be utilized in a luffing orientation and a standard orientation, wherein the luffing orientation is defined by a declined angle between the jib assembly and the boom assembly being variable, wherein the standard orientation is defined by the declined angle being fixed.

13. The stowable luffing jib of claim 12, wherein the declined angle is varied by elongating and shortening the luffing guy line so as to pivot the stowable luffing jib relative to the boom assembly.

14. A crane comprising:

a base;

a boom assembly presenting a proximal end and a distal end, wherein the proximal end of the boom assembly is rotatably secured to the base, a first winch for selectively releasing a load line to support a load;

a second winch for selectively releasing a luffing guy line to set a declined angle; and a stowable luffing jib associated with the boom assembly, said stowable luffing jib configured to be selectively placed into a stowed orientation and a deployed orientation, wherein said stowed orientation is defined by the stowable luffing jib being secured to a transportation bracket on an outer boom section of the boom assembly, wherein the said load line lifts the load via the distal end of the boom assembly while the stowable luffing jib is in the stowed orientation, wherein said deployed orientation is defined by the stowable luffing jib being installed on the distal end and set at said declined angle, such that the load line lifts the load via the stowable luffing jib.

15. The crane of claim 14, further comprising:

a static-operations cab disposed on a first side of the boom assembly, wherein the static-operations cab is configured to remain aligned with the boom assembly during rotation of the boom assembly.

16. The crane of claim 15, further comprising:

wherein said transportation bracket is disposed on a second side of the boom assembly, such that the stowable luffing jib being disposed in the transportation bracket does not obstruct an operator's view from the static operations cab, wherein the first side of the boom assembly is different than and opposite the first side.

17. The crane of claim 14, wherein the stowable luffing jib is configured to pivot from the stowed position to the deployed position through a substantially horizontal plane, wherein the stowable luffing jib is configured to be secured onto the distal end of the boom assembly by a lock bolt.

18. The crane of claim 17, wherein the stowable luffing jib is configured to be placed by the operator from the stowed position to the deployed position using manual power.

* * * * *